US005909169A

United States Patent [19]

Lin

[11] Patent Number: 5,909,169

[45] Date of Patent: Jun. 1, 1999

[54] ELECTRIC BELL HAVING A MECHANISM FOR SUPPORTING ELECTROMAGNETIC UNIT

[76] Inventor: Sheng-Hsiung Lin, No. 306, Wu Fu Road, Wu Fu Tsuen, Wu Feng Hsiang, Taichung Hsien, Taiwan

[21] Appl. No.: 08/920,194

[22] Filed: Aug. 25, 1997

[51] Int. Cl.[6] ..... G08B 3/00

[52] U.S. Cl. ..... 340/384.73; 340/392.1; 340/396.1; 340/398.2; 116/148

[58] Field of Search ..... 340/384.1, 384.7, 340/384.73, 392.1, 398.2; 116/148

[56] References Cited

U.S. PATENT DOCUMENTS 4,912,453 3/1990 Aizawa et al. ..... 340/396.1

4,968,971 11/1990 Aizawa et al. ..... 340/397.3

*Primary Examiner*—Edward Lefkowitz

*Attorney, Agent, or Firm*—Charles E. Baxley, Esq.

[57] ABSTRACT

An electric bell includes a base having two walls extended upward from the central portion for forming a casing. The walls each includes an upper portion having one or more projections. Two spring leaves are secured on the base. An electromagnetic unit is engaged into the casing and engaged between the walls and retained in place by the projections. The electromagnetic unit includes a coil and a stem slidably engaged in the coil for allowing the stem to be driven by the coil to strike onto the spring leaves. The electromagnetic unit may be secured in place without additional tools and fasteners.

3 Claims, 3 Drawing Sheets

ELECTRIC BELL HAVING A MECHANISM FOR SUPPORTING ELECTROMAGNETIC UNIT

BACKGROUND OF THE INVENTION

1. Field of the Invention

The present invention relates to an electric bell, and more particularly to an electric bell having a mechanism for supporting an electromagnetic unit.

2. Description of the Prior Art

Typical electrical bells comprise an electromagnetic unit disposed between two spring leaves and having a stem that may be driven to strike the spring leaves. However, the typical electric bell has no supporting mechanism designed for supporting the electromagnetic unit such that a number of fasteners and a number of supporting ribs or walls are required to be secured to the electric bell for supporting the electromagnetic unit, and such that the electromagnetic unit may not be easily secured in place. A number of additional tools are required for assembling or attaching the electromagnetic unit to the electric bell.

The present invention has arisen to mitigate and/or obviate the afore-described disadvantages of the conventional electric bells.

SUMMARY OF THE INVENTION

The primary objective of the present invention is to provide an electric bell including a specially designed mechanism for supporting the electromagnetic unit and for allowing the electromagnetic unit to be easily secured in place without additional tools and fasteners.

In accordance with one aspect of the invention, there is provided an electric bell comprising a base including a central portion having two walls extended upward for forming a casing, the walls each including an upper portion having at least one projection, two spring leaves secured on the base, and an electromagnetic unit engaged into the casing and engaged between the walls and retained in place by the projections, the electromagnetic unit including a coil and a stem slidably engaged in the coil for allowing the stem to be driven by the coil to strike onto the spring leaves. The electromagnetic unit is engaged into the casing through the at least one projections for allowing the electromagnetic unit to be secured in place without additional tools and fasteners.

The walls each includes two flanges for engaging with and for retaining the electromagnetic unit in place. The walls each includes at least one groove for defining a resilient blade, the at least one projection is formed on the resilient blade.

Further objectives and advantages of the present invention will become apparent from a careful reading of the detailed description provided herein below, with appropriate reference to the accompanying drawings.

DETAILED DESCRIPTION OF THE PREFERRED EMBODIMENT

Figure 1:
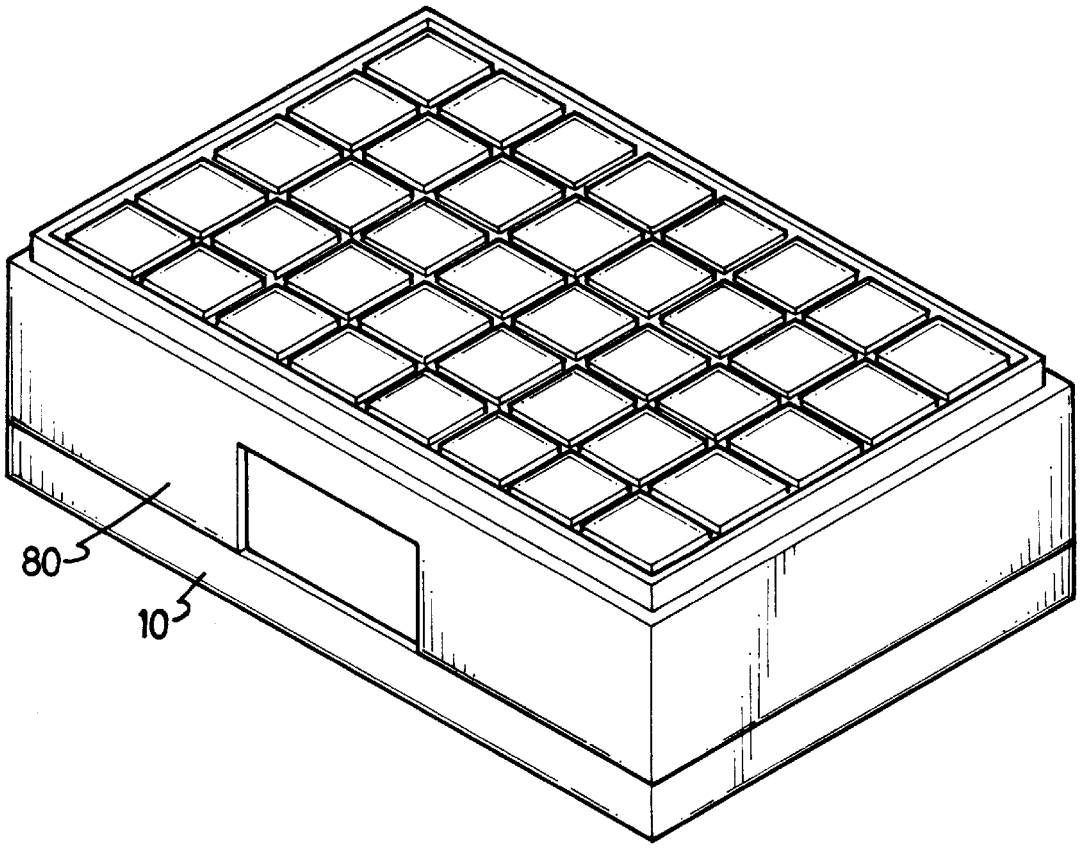
FIG. 1 is a perspective view of an electric bell in accordance with the present invention.

Referring to the drawings, and initially to FIG. 1, an electric bell in accordance with the present invention comprises a base 10 and a cover 80 secured on top of the base 10 for forming the outer appearance of the electric bell.

Figure 2:
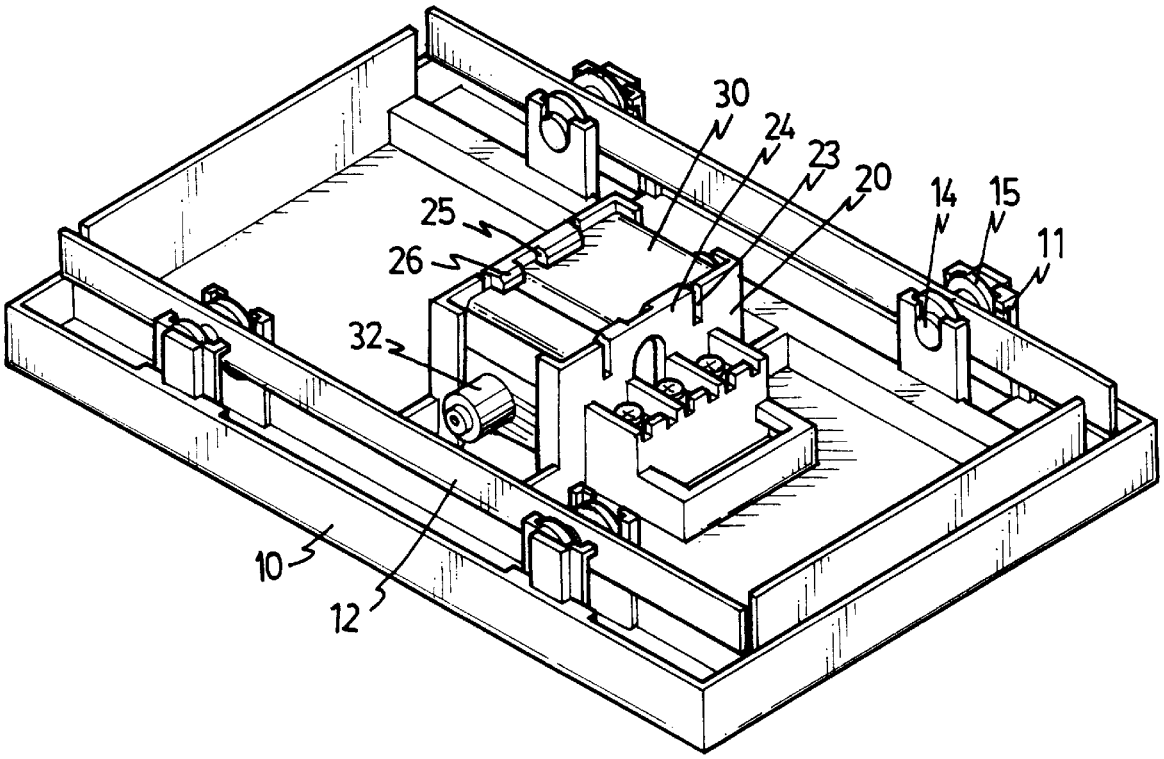
FIG. 2 is a perspective view of an electric bell in which the cover has been removed for showing the interior mechanism of the electric bell.
Figure 3:
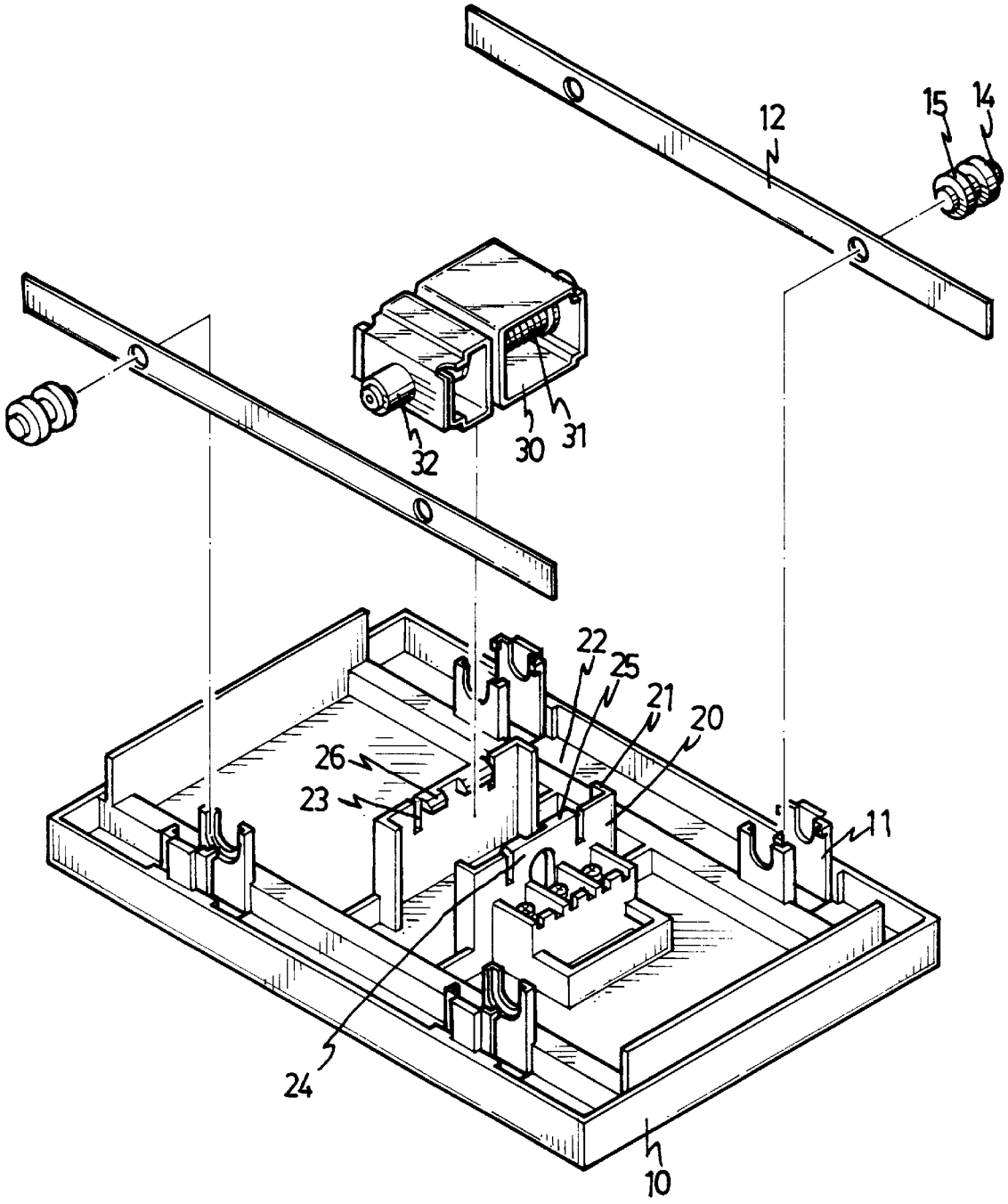
FIG. 3 is a partial exploded view illustrating the electromagnetic unit of the electric bell.

As shown in FIGS. 2 and 3, the base 10 of the electric bell includes four pairs of ears 11 for supporting four rods 14. Two spring leaves 12 are secured on the rods 14 and are preferably arranged in parallel to each other. The rods 14 each includes two stops or gaskets 15 for retaining the spring leaves 12 in place. The base 10 includes two walls 20 extended upward from the center portion of the base 10 for forming a casing and each having two flanges 21 for defining two openings 22. The walls 20 each includes one or two grooves 23 for defining a resilient blade 24 and each includes one or more projections 25 extended from the upper portion of the resilient blade 24 for retaining and securing an electromagnetic unit 30 in place. The electromagnetic unit 30 includes a coil 31 and a stem 32 slidably engaged in the coil 31 so as to be driven by the coil 31 in order to strike onto the spring leaves 12 and in order to generate bells. The cover 80 may enclose the parts and elements and may protect the parts and the elements.

It is to be noted that the projections 25 each preferably includes a tapered surface 26 formed on top for allowing the electromagnetic unit 30 to be easily engaged into the casing formed by the walls 20. The resilient blades 24 may be slightly bent and may allow the electromagnetic unit 30 to be easily engaged into the casing formed by the walls 20. The walls 20 may be easily formed by plastic material. The electromagnetic unit 30 may thus be easily secured in place without additional tools or fasteners which are normally made of metal material and which may, in some cases, affect the operation of the electromagnetic unit 30.

Accordingly, the electric bell in accordance with the present invention includes two walls 20 having resilient blades 24 and projections 25 for easily and quickly securing the electromagnetic unit 30 in place without additional tools and fasteners.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An electric bell comprising:

a base including a central portion having two walls extended upward for forming a casing, said walls each including an upper portion having at least one projection, two spring leaves secured on said base, and an electromagnetic unit engaged into said casing and engaged between said walls and retained in place by said projections, said electromagnetic unit including a coil and a stem slidably engaged in said coil for allowing said stem to be driven by said coil to strike onto said spring leaves, said electromagnetic unit being engaged into said casing through said at least one projections for allowing said electromagnetic unit to be secured in place without additional tools and fasteners.

2. An electric bell according to claim 1, wherein said walls each includes two flanges for engaging with said electromagnetic unit and for retaining said electromagnetic unit in place.

3. An electric bell according to claim 1, wherein said walls each includes at least one groove for defining a resilient blade, said at least one projection is formed on said resilient blade.

* * * * *